United States Patent [19]

John

[11] 4,059,189

[45] Nov. 22, 1977

[54] CLASSIFICATION OF PARTICLES

[75] Inventor: Ronald John, High Wycombe, England

[73] Assignee: Vacu-Blast Limited, Slough, England

[21] Appl. No.: 672,743

[22] Filed: Apr. 1, 1976

[30] Foreign Application Priority Data

Apr. 3, 1975 United Kingdom ..... 13734/75

[51] Int. Cl.[2] ..... B07C 9/00

[52] U.S. Cl. ..... 209/112; 209/115

[58] Field of Search ..... 209/73, 112, 114, 115, 209/118; 222/196, 457

[56] References Cited

U.S. PATENT DOCUMENTS

| | | | |
|---|---|---|---|
| 1,119,662 | 12/1914 | Sutton et al. | 209/112 |
| 2,068,146 | 1/1937 | Medcalf | 209/112 |
| 2,286,607 | 6/1942 | Dyer et al. | 209/112 |
| 2,658,616 | 11/1953 | Stutzman | 209/112 |
| 3,012,697 | 12/1961 | Rouse et al. | 222/196 X |
| 3,618,828 | 11/1971 | Schinella | 222/457 X |

FOREIGN PATENT DOCUMENTS

| | | | |
|---|---|---|---|
| 18,368 | 8/1881 | Germany | 209/112 |
| 1,297,788 | 11/1972 | United Kingdom | 209/112 |

*Primary Examiner*—Robert B. Reeves
*Assistant Examiner*—Joseph J. Rolla
*Attorney, Agent, or Firm*—St. Onge, Mayers, Steward & Reens

[57] ABSTRACT

In order to grade or classify particles according to their sphericity, the particles are fed onto a moving surface which has a gentle slope in the direction transverse to the direction of movement so that the particles move down the slope while being carried along by the moving surface. The rate of movement down the slope depends on the particle shape so that particles of different shape reach the lower edge of the surface at different positions. This movement of the particles is facilitated by vibrating the surface or moving it intermittently. The surface is preferably a rotating disk.

20 Claims, 3 Drawing Figures

CLASSIFICATION OF PARTICLES

This invention relates to the classification according to their sphericity of particles such as the shot used for shot blasting or shot peening.

Blasting or peening shot should be substantially spherical and preferably should contain a predetermined range of shot sizes in predetermined proportions. However during manufacture, and as a result of degradation in use, shot may contain deformed or broken particles, and in use the shot becomes mixed with fragments of debris, and powder, which should be separated. It is therefore necessary to be able to separate substantially spherical particles from deformed or broken particles and other materials.

It is known to classify spherical particles by feeding them on to the upper surface of a rotating disk so that they migrate towards the periphery of the disk at rates depending on the friction between the particles and the disk and hence on the particle shapes, so that non-spherical particles are carried further round the disk whereas spherical particles rapidly reach the edge of the disk and fall from this (British Patent Specification No. 1,297,788).

In practice, the speed of rotation has to be kept to a relatively low value in order to prevent the particles from bouncing. This however reduces the centrifugal force acting on the particles and hence the rate of separation. For blasting and peening shot, with particle diameters typically 100 to 1500 microns, the rate of rotation in general should not exceed about 35 rpm, preferably 10 rpm, which does not give a satisfactory rate of separation of the particles.

It is an object of the present invention to provide a method and apparatus for classifying particles according to their sphericity, in which undesirable bouncing of the particles is avoided while a satisfactory rate of separation of the particles is maintained.

According to the invention there is provided a method of classifying particles according to their sphericity, wherein the particles are placed on an upper region of a moving surface which slopes in a direction transverse to the direction of movement of the surface whereby the particles are carried along on said surface and simultaneously migrate down the slope at rates dependent on the sphericity of the individual particles, and the particles which have migrated leave the said surface respectively at different positions spaced in the said direction and of which at least one is at a lower region of the surface.

Also according to the invention there is provided apparatus for classifying particles according to their sphericity, comprising a particle-conveying surface, driving means for moving the said surface in one direction, the said surface having a slope transverse to the said direction, feeding means for feeding particles to an upper region of the said surface, and a plurality of collecting means for receiving the particles from the said surface at respective positions spaced, in the said direction, from the feeding means.

Thus, the particles are subjected to a component of the force due to gravitation acting down the slope. The acceleration of particles under the effect of gravitation depends on the slope of the surface and is not affected by its speed of movement. Accordingly it is possible to effect rapid separation of particles of different shapes without having to increase the speed of movement of the surface to a value at which the particles would bounce. It will be understood that since the different rates of movement of particles of different shapes depend on the friction between the particles and the surface, bouncing would disturb the separation process.

The moving surface can be a rotating disk, in which case the slope extends downwards from the central region of the disk to its periphery so that the disk is a flattened cone; in this case the particles are subjected to centrifugal force due to the rotation, as well as to gravitation. Alternatively the moving surface can be a conveyor belt.

In general, it will be necessary forcibly to remove particles which have not left the surface by virtue of their migration down the slope, after a predetermined residence on the surface. This can be carried out e.g. by means of a scraper, or by suction or an air jet, or in the case of an endless conveyer belt and residual particles can be simply discharged over the downstream end of the belt. However it is also possible for all of the particles to leave the moving surface by way of its lower region, if no particles of grossly non-spherical shape are present.

The particles may leave the lower region of the surface by gravitation, i.e. by falling from the edge of the surface, or they may be forcibly removed e.g. by means of air-jets or suction devices.

In general, the particles leaving the lower region of the moving surface at different positions distributed in the direction of movement of the surface will be collected separately e.g. by two or more hoppers at the edge of the surface. However, in the case in which an appreciable number of particles remain on the surface without reaching the said lower region, the particles may be classified simply into two groups namely those which are sufficiently spherical to leave the moving surface at its lower region, and those which are not. For example, the invention can be used for grading abrasive particles in which the desired end product comprises the angular abrasive particles which do not migrate appreciably down the slope of the moving surface, and the spherical and near-spherical particles which do migrate are to be rejected. However, in general the desired end product will be the spherical and near-spherical particles, which may be simply separated from broken or deformed particles and foreign matter such as dust, or may be further classified according to their differing degrees of sphericity.

A problem which can arise in the classification of particles, at least when the particle density on the moving surface is high, is that particles which migrate slowly or not at all can obstruct faster-moving particles. To overcome this, according to a further feature of the invention the particles are shaken, either by the application of vibration to the moving surface or by causing the surface to move intermittently. The shaking motion of the particles is preferably substantially parallel to the surface, since shaking perpendicular to the surface may cause the particles to bounce and in any case has substantially equal effects on the spherical and non-spherical particles, whereas the object of the shaking is to cause the spherical and near-spherical particles to move on the surface relative to non-spherical particles so as to avoid obstruction by the latter. The shaking movement is preferably substantially in the direction of motion of the moving surface.

According to a further aspect of the invention, there is provided apparatus for feeding particulate material, comprising a feeding head with an internal chamber and an inlet communicating with an upper region of the chamber, and a lateral outlet of which the lower edge of the end which opens into the chamber is not lower than a line extending from the nearest part of the inlet at an angle to the horizontal equal to the angle of repose of the particles; and a vibrator coupled to the feeding head.

In such feeding apparatus, the particles will not leave the feeding head until vibration is applied to the latter to destroy the natural slope of the particles in the feeding head chamber at the angle of repose. The flow of particles can be stopped and started simply by stopping and starting the vibrator and the rate of flow can be controlled by adjustment of the vibrator and/or by adjustment of the angle of the head relative to the horizontal.

The invention will be further described with reference to the accompanying drawings, in which.

Figure 1:
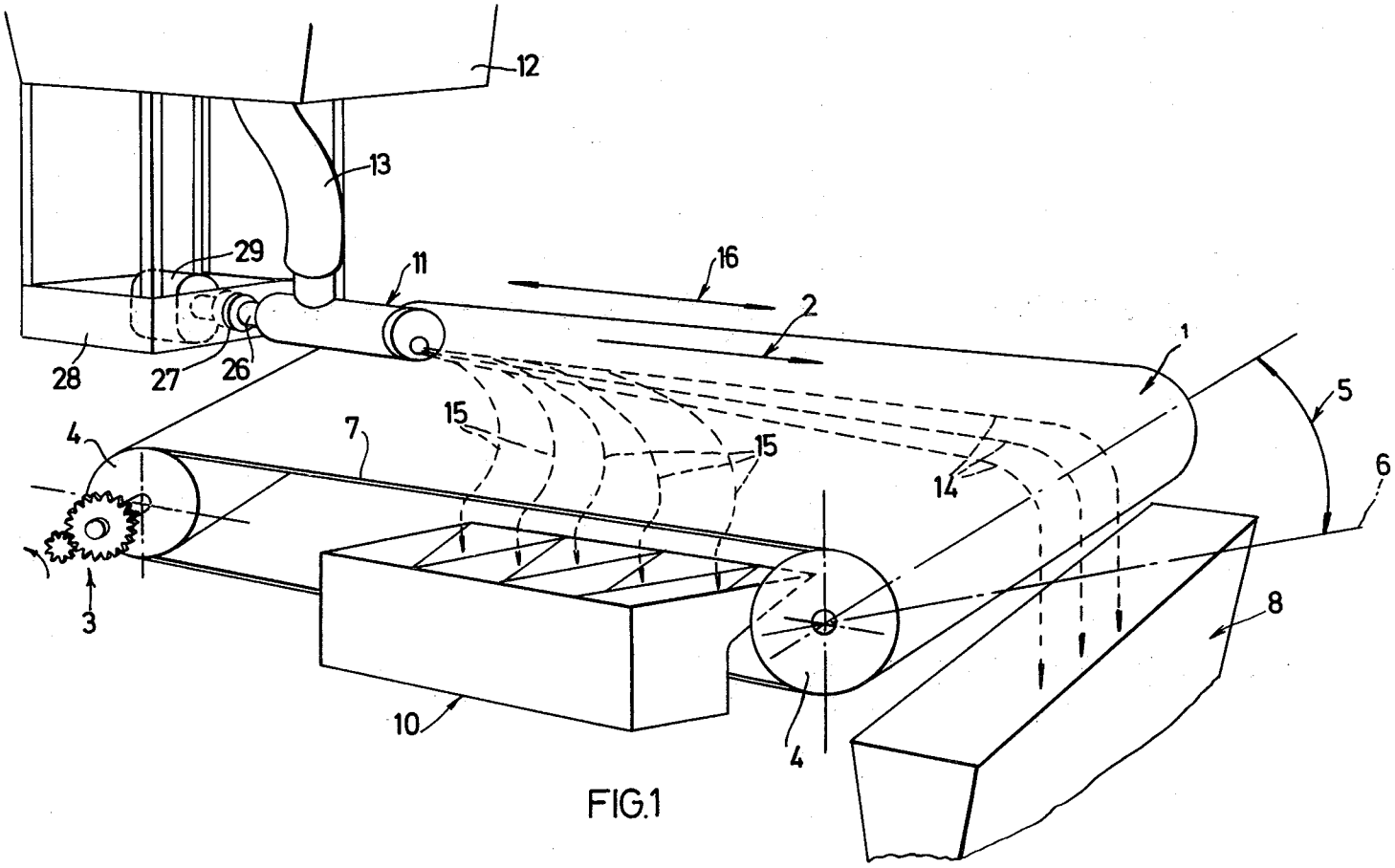
FIG. 1 shows apparatus according to the invention for classifying particles of shot, using an endless conveyer belt.

FIG. 1 shows, very schematically, apparatus for classifying according to their sphericity particles of blasting or peening shot, which may be newly manufactured shot or shot which has been used for blasting or peening. The apparatus separates broken or deformed particles, dust and other foreign matter from spherical and near-spherical particles, and the latter are classified according to their sphericity.

The apparatus shown includes an endless conveyer belt 1 which is driven in the direction of the arrow 2 by means of an electric motor (not shown) and reduction gearing 3. The longitudinal direction of the belt, that is to say the direction of movement of its upper surface, is horizontal. However, the end rollers 4 are tilted at an angle 5 relative to a horizontal line 6 perpendicular to the direction of movement of the belt, and accordingly the upper surface of the belt has a downward slope towards the front edge 7. A hopper 8 is provided below the downstream end 9 of the belt. A plurality of hoppers 10 are mounted along the lower side of the belt, and a feed head 11 is mounted immediately above the upper surface of the belt in the upper region of its upstream end. The feed head 11 receives shot particles from a feed hopper 12 through a flexible pipe 13.

In operation, the belt is driven slowly in the direction of the arrow 2 and a controlled stream of particles is fed to it from the feed head 11. Because of the transverse slope of the belt, the particles will tend to migrate towards the edge 7 of the belt at a speed depending on the coefficient of friction between the individual particles and the belt surface. If the coefficient of friction is excessive the migration of the particles down the slope will be negligible and such particles will be carried to the downstream end of the belt and discharged into the hopper 8 as shown by the broken lines 14. Spherical and near-spherical particles will migrate down the slope at different speeds according to their shapes and will accordingly take different times to reach the lower edge 7 of the belt. Since they are simultaneously carried along by the belt, particles of different shapes will reach the lower edge 7 at different positions along the latter shown by the broken lines 15, and will then fall into respective hoppers 10 from which they can be removed continuously or at intervals. The speed and transverse slope angle of the belt are selected with reference to the nature of the particles, to provide the desired degree of separation as between the different hoppers 10. As already mentioned, if the intention is simply to eliminate waste material, a single hopper 10 may suffice.

To assist the downwardly migrating particles in passing obstructions caused by groups of broken or deformed particles or foreign material, the particles may be shaken by vibration of the belt as shown by the arrow 16, or by including an intermittent-advance mechanism in the drive to the belt.

Figure 2:
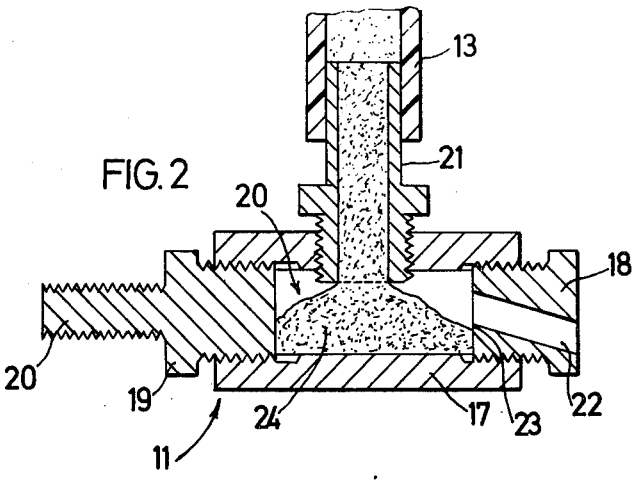
FIG. 2 shows a cross section of a feeding head for feeding particles to the conveyer belt.

Details of the feed head 11 are shown in FIG. 2. A cylindrical body member 17 and end plugs 18, 19 define a chamber 20 provided with an upright inlet tube 21 extending through the top of the body member 17 and connected to the flexible pipe 13. The end plug 19 has a mounting spigot 20, and the end plug 18 is traversed by an outlet passage 22 which slopes downwards from its inlet end to its outlet and which may, as shown in FIG. 1, have an oval cross section. Its minimum width is preferably not much greater than the diameter of an average individual particle, and may e.g. be 5 to 10 mm.

When the shot is fed from the hopper 12 into the chamber 20, it will pile up in the chamber until the surface of the pile reaches the lower end of the inlet 21 and rests at the angle of repose of the particles. The inlet is then effectively blocked and no further inflow of particles will take place. The lower edge 23 of the inner end of the outlet passage 22 is spaced above the bottom of the chamber 20 so as to be not lower than an imaginary line drawn, at the angle of repose (typically 5° – 20°), from the nearest part of the particle inlet to the chamber towards the outlet passage 22, so that the surface of the pile 24 of particles in the chamber 20 will not rise above the lower edge 23 of the inner end of the outlet passage 22 and accordingly particles will not flow out of the feed head. However when vibration is applied to the feed head the coherence of the pile of particles is destroyed and its surface becomes flatter so that the surface of the pile adjacent to the end plug 18 rises (with more particles going in from the hopper 12) and particles can then flow out through the passage 22. Particle flow will cease when vibration ceases. Thus, as shown in FIG. 1, the spigot 26 is mounted in a rubber bush 27 in a frame 28 and is coupled to a vibrator 29, e.g. an electrical mains-powered electromagnetic vibrator.

The rate of outflow of particles depends on the angle of the feed head with respect to the horizontal direction and can be increased by tilting the feed head clockwise as seen in FIG. 2, the maximum rate of flow being limited by the capacity of the outlet passage 22. The outer end of the passage 22 should be placed as close to the surface of the conveyor belt 1 as possible.

The end plug 18 may be replaceable to provide passages of different shape and/or size to suit different kinds or sizes of particle.

It will be understood that FIG. 1 is very schematic and, in particular, for simplicity does not show the essentially conventional conveyer frame and other mounting and supporting means for the components illustrated.

Figure 3:
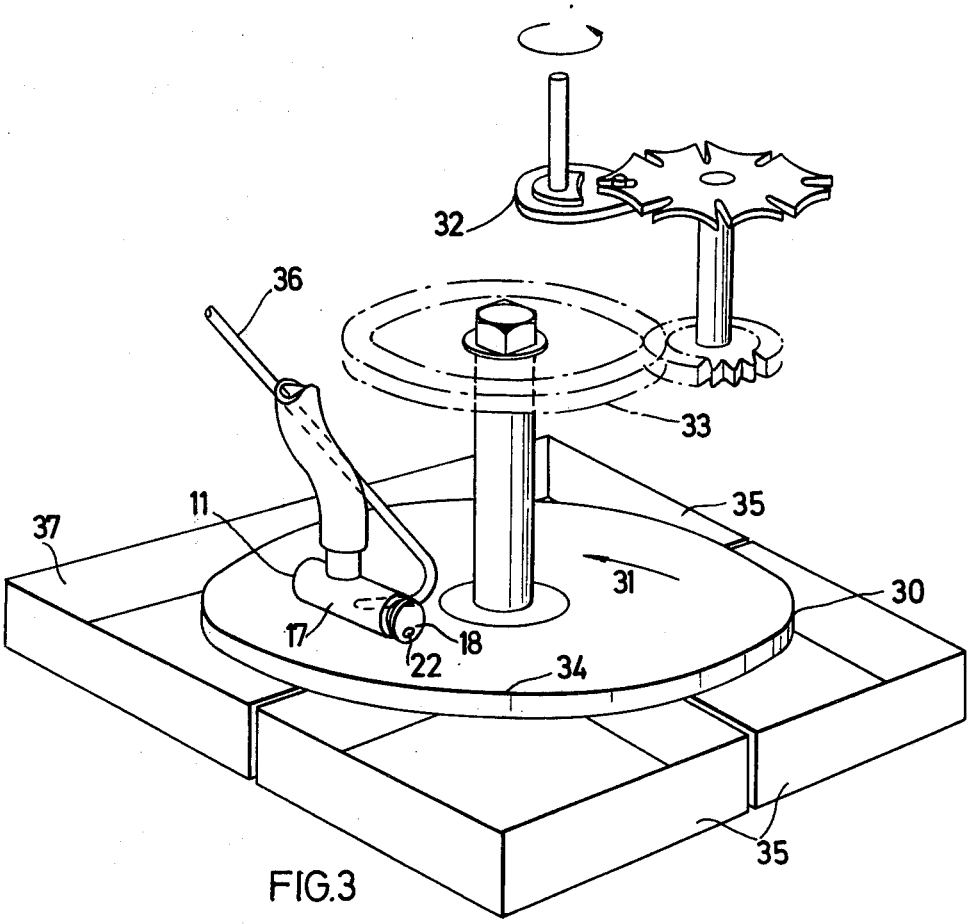
FIG. 3 shows apparatus for classifying particles, using a rotating disk.

FIG. 3 shows a particle classifier in which a disk 30 rotating about its own axis, which is vertical, is used instead of a conveyer belt. The disk is driven in the direction of the arrow 31 by means of an electric motor (not shown), a Geneva mechanism 32 and reduction gearing 33, so that the rotation is intermittent. The upper surface of the disk is a very shallow cone, sloping down from the central region to the periphery of the disk at an angle of 1° to 5°, e.g., 2°. Shot particles to be classified are fed to the upper, inner region of the disk by a feed head 11 as already described, and are carried round by the disk while at least some of the particles migrate down the slope towards the edge 34 of the disk. In this case, the migration of the particles will be assisted by the centrifugal acceleration due to the rotation of the disk. Particles of spherical and near-spherical shape will reach the edge of the disk at different positions and fall off into respective collectors 35. Particles which are still on the disk after slightly less than one complete revolution, i.e. grossly non-spherical particles and foreign matter, are removed from the surface of the disk by an air pipe 36 from which issues a jet of air which blows the residual material from the disk into a waste receptacle 37.

The step-wise rotation, e.g. at 1–10 r.p.m, of the disk assists the separation of spherical from non-spherical particles as already described. Alternatively, the disk may be driven at a constant speed of e.g. 1–35 rpm and subjected to vibration. Vibration in the frequency range 25 to 100 Hz, e.g. electrical mains frequency, has been found to be satisfactory.

The vibration is preferably in the circumferential direction of the disk, i.e. rotary, but a rectilinear horizontal vibration can also be used.

Instead of being conical, the upper surface of the disk may be convex or concave in radial cross section.

The intermittent rotation or vibration of the disk causes spherical and near-spherical particles to roll backwards and forwards relative to the surface of the disk whereas non-spherical particles remain stationary, so that the spherical and near spherical particles are able to move round the stationary non-spherical particles.

The rotational speed of the disk will in general be relatively slow in order to prevent bouncing of the particles, and consequently the effect of centrifugal force in causing radial migration of the particles will be relatively small.

For separating shot particles, the disk may for example have a diameter of 20 to 40 cm. In the case of intermittent rotation, the disk may advance at 1 to 10 rpm and 40 to 150 steps per revolution, viz 40–1500, preferably 300 to 500 steps per minute. If the disk is vibrated, the vibration frequency is preferably in the range 25 to 100Hz, e.g. electrical mains frequency and the rate of rotation can be 1–35 rpm. Satisfactory results have been obtained with a disk of polished aluminium of diameter 25 cm and a uniform slope of 2°, rotated intermittently at 400 steps per minute, when tested with particles of glass and steel of diameters 100 to 1500 microns.

The degree of separation of the particles depends on the radial slope of the disk, its rate of rotation, and the violence of the skaking action, any or all of which can be adjusted to achieve the desired separation. The degree of separation can also be controlled to some extent by changing the radial position of the feed head, which is typically at a radius of about 9 cm from the centre of the disk.

The rate of rotation of the disk also has an effect on the rate at which particles can be fed to it, because the number of particles which can be accommodated on the disk surface is limited, if effective separation is to be achieved. The higher the rate of rotation, the higher the rate of feed that is possible. Satisfactory separation has been achieved with apparatus as shown in FIG. 3, using feed rates in the range 5 grams per minute to 250 grams per minute.

Separation is also affected by the nature of the disk surface since this affects the friction between the surface and the particles.

To reduce the inertia of the disk and thereby increase the abruptness of the shaking, the disk may be a lightweight plastics moulding, coated e.g. with metal to reduce wear and/or static electricity.

The particles fed to the disk (or belt) may be of mixed sizes or may be previously classified so as to be of substantially uniform size. Size classification can e.g. be carried out using rotating screen drums whose axes slope downwards and to the upper ends of the interiors of which the particles are fed. For example, size-classification apparatus may comprise a plurality of coaxial cylindrical screens the apertures in whose walls decrease from the innermost screen to the outermost screen. The unclassified particles are fed in at one end of the inner most screen and the screens are rotated, the particles being caused to move along the screens by tilting the axis of the screens and/or by providing oblique ribs inside each screen, the particles being collected respectively at the outlet ends of the screens and at the outside of the outermost screen. The screens may e.g. be made of woven wire or perforated sheet metal. A separate shape-classification apparatus may be provided for each size group of particles. In the case of blasting or peening shot, if the particles are subjected to size classification, the particles will in general be remixed after shape classification so as to provide in the mixture a desired range of sizes in predetermined proportions.

The shape-classification apparatus may e.g. comprise a plurality of disks spaced vertically on a common axis, and fed in parallel or in series. For example, such an assembly of disks may comprise a respective disk for each of a number of size groups of particles.

In practice, a single apparatus may be provided comprising size-classification means feeding hoppers from which the particles are fed to shape-classifying means of the kind described.

I claim:

1. A method of classifying particles according to their sphericity which comprises placing the particles on an upper region of a smooth surface which rotates about a vertical axis and slopes downwardly from said axis, and introducing a cyclic component into the rotation of said surface effecting shaking of the particles in a circumferential direction parallel to said surface, whereby the particles are carried along on said surface in said circumferential direction and simultaneously migrate radially down the slope at rates dependent on the sphericity of the individual particles, the particles which have migrated leaving said surface respectively at different positions spaced in said direction, at least one of said positions being at a lower region of the surface.

2. A method as claimed in claim 1 in which particles which after a predetermined residence on the surface have not migrated to and left the lower region thereof are removed from the surface separately from the particles leaving the said lower region.

3. A method as claimed in claim 1 in which particles which have migrated at different rates are collected from the said lower region at respective positions distributed in the direction of movement of the surface.

4. A method as claimed in claim 1 in which said surface rotates at 1 to 35 r.p.m.

5. A method as claimed in claim 1 in which said surface is rotated intermittently at a rate of 40 to 150 steps per revolution.

6. A method as claimed in claim 1 in which the surface slopes down at about 2° to the horizontal.

7. A method as claimed in claim 1 in which movement of the said surface is intermittent.

8. A method as claimed in claim 7 in which the said surface is moved at a rate of 40–1500 steps per minute.

9. A method as claimed in claim 1 in which the said surface is vibrated substantially parallel to the said surface.

10. A method as claimed in claim 9 in which the vibration frequency is 25–100 Hz.

11. Apparatus for classifying particles according to their sphericity comprising a rotatable disk having a smooth upper surface, the axis of rotation being vertical and the upper surface sloping downwardly from said axis, driving means for rotating said disk, feeding means for feeding particles to an upper region of said surface, a plurality of collecting means for receiving the particles from said disk at respective positions spaced from said feeding means in the direction of rotation, and shaking means for imposing a cyclic component on the rotation of said disk for agitating said particles in a circumferential direction parallel to said surface.

12. Apparatus as claimed in claim 11 including removal means spaced from the feeding means in the said direction for forcibly removing the particles from the said surface.

13. Apparatus as claimed in claim 11 in which the collecting means comprise receptacles arranged to receive particles falling from a lower edge of the said surface.

14. Apparatus as claimed in claim 11 in which the slope of the surface is at substantially 2° to the horizontal.

15. Apparatus as claimed in claim 11 in which the feeding means comprise a hopper for the particles connected by a downwardly extending conduit to a feeding head which has an internal chamber of which an upper region has an inlet which communicates with the conduit, and a lateral outlet of which the lower edge of the end which opens into the chamber is not lower than a line extending from the nearest part of the inlet at an angle to the horizontal equal to the angle of repose of the particles; and a vibrator coupled to the feeding head.

16. Apparatus as claimed in claim 11 in which the driving means incorporates an intermittend-transmission mechanism.

17. Apparatus as claimed in claim 16 in which the driving means is adapted to advance the said disk at 40–150 steps per revolution.

18. Apparatus as claimed in claim 11 including a vibrator coupled to the said surface.

19. Apparatus as claimed in claim 18 in which the vibrator has a vibration frequency of 25–100 Hz.

20. Apparatus as claimed in claim 18 in which the vibrator is arranged to vibrate the said surface substantially in the plane of the latter.

* * * * *